United States Patent [19]

Hague

[11] 4,223,503

[45] Sep. 23, 1980

[54] JOINT FOR BUILDING PANELS

[75] Inventor: James G. Hague, Mars, Pa.

[73] Assignee: H. H. Robertson Company, Pittsburgh, Pa.

[21] Appl. No.: 14,999

[22] Filed: Feb. 26, 1979

Related U.S. Application Data

[63] Continuation-in-part of Ser. No. 905,025, May 11, 1978, abandoned.

[51] Int. Cl.[2] ..... E04D 3/361; E04D 1/34

[52] U.S. Cl. ..... 52/478; 52/394; 52/522; 52/529; 52/530; 52/588

[58] Field of Search ..... 52/394, 478, 522, 529, 52/534, 588

[56] References Cited

U.S. PATENT DOCUMENTS

| | | | |
|---|---|---|---|
| 95,732 | 10/1869 | Roys | 52/522 |
| 1,090,334 | 3/1914 | Norman | 52/529 X |
| 2,019,379 | 10/1935 | Anderson | 52/588 X |
| 3,127,962 | 4/1964 | James | 52/588 |
| 3,481,094 | 12/1969 | Taylor | 52/534 X |
| 3,511,011 | 5/1970 | Straus | 52/520 X |
| 3,841,776 | 10/1974 | Klaus | 52/588 |

FOREIGN PATENT DOCUMENTS

| | | | |
|---|---|---|---|
| 1336774 | 7/1963 | France | 52/529 |
| 771093 | 2/1977 | South Africa | 52/522 |

*Primary Examiner*—Alfred C. Perham
*Attorney, Agent, or Firm*—George E. Manias

[57] ABSTRACT

Upstanding polysurfaced male and female lips are provided along confronting edges of adjacent elements, such as building panels. The female lip is engaged over the male lip and when rotated about the male lip is snap-fitted into interlocked relation therewith. The lips provide an upstanding joint which secures the adjacent elements in fixed angular relation to each other. The lips are interengaged along plural angularly spaced-apart regions and are overlapped such that vertical and lateral disengagement of either lip relative to the other is precluded along the entire length of the joint.

25 Claims, 19 Drawing Figures

JOINT FOR BUILDING PANELS

CROSS-REFERENCES TO RELATED APPLICATIONS

This application is a continuation-in-part of copending application Ser. No. 905,025 filed May 11, 1978 and now abandoned and assigned to the assignee of this invention.

BACKGROUND OF THE INVENTION

1. Field of the Invention

This invention relates to joints between elements, such as building panels, and more particularly to polysurfaced male and female lips which are interlocked to provide an upstanding joint.

2. Description of the Prior Art

The prior art discloses numerous examples of joints which secure together adjacent sheet metal panels without the necessity of crimping or otherwise deforming the elements of the joint. Typical examples include U.S. Pat. Nos. 2,019,379 (ANDERSON); 3,127,962 (JAMES); 3,481,094 (TAYLOR); 3,511,011 (STRAUS).

The ANDERSON joint is particularly suited for use in connecting the slats of a rolling metal curtain. When used in wall or roof structures, the male lip may be partially disengaged from the female lip by loads applied at locations adjacent to the male lip. The possible partial disengagement precludes formation of a reliable weather-tight seal.

The JAMES joint avoids the partial disengagement problem by providing tightly nested cylindrically-shaped connecting members. A lubricant must be applied to the contacting surfaces of the connecting members to facilitate interconnection. The cylindrically-shaped connecting members have substantially identical girths and therefore appear to utilize more material than is actually necessary.

The TAYLOR joint also attempts to avoid the partial disengagement problem discussed above by providing an inwardly extending crimp on the female lip which is engaged by the terminal edge of the male lip. Despite the presence of the crimp, the male lip is still subject to deflection by applied loads and degradation of the weather-tight seal.

The STRAUS joint utilizes intricately formed male and female lips of single and double metal thickness, respectively. The female lip is particularly subject to damage during packaging, shipment and erection. Such damage would interfere with the interconnection of the lips and the formation of a weather-tight seal.

SUMMARY OF THE INVENTION

The principal object of this invention is to provide an upstanding joint structure useful in connecting elements, such as building panels.

Another object of this invention is to provide an upstanding joint comprising polysurfaced male and female lips which are self-seating and self-aligning thereby precluding vertical and lateral movement of either lip relative to the other due to non-uniform loading.

A further object of this invention is to provide polysurfaced male and female lips which are hooked together and then rotated relative to each other, the lips undergoing a snap-fit during relative rotation whereby counter-rotation and disengagement of either lip from the other is resisted.

A still further object of this invention is to provide an upstanding joint structure which effectively locks adjacent building panels together without the use of supplemental fastening means and without the necessity of subsequent seaming operations.

The present invention provides an upstanding joint for connecting adjacent central webs which present confronting first and second web edges. The joint comprises polysurfaced female and male lips adjoined, respectively, to the first and second web edges.

The polysurfaced female lip comprises, in sequence, relative to the first web edge: an upwardly and inwardly extending first element, an upwardly and outwardly extending second element, an outwardly extending third element, an outwardly and downwardly extending fourth element, and a reentrant terminal element.

The polysurfaced male lip comprises, in sequence, relative to the second web edge: an upwardly and outwardly extending first leg which overlaps the first element, and a re-entrant arcuate terminal leg engaged with the re-entrant terminal element. The first leg and the terminal leg are joined by at least two distinct legs and intermediate thereof at least one arcuate bend which is disposed in engagement with an interior surface of the female lip.

The male lip is interlocked with the female lip thereby to provide the present joint which secures the adjacent central webs in fixed angular relation to each other.

DESCRIPTION OF THE PREFERRED EMBODIMENT(S)

Figure 1:
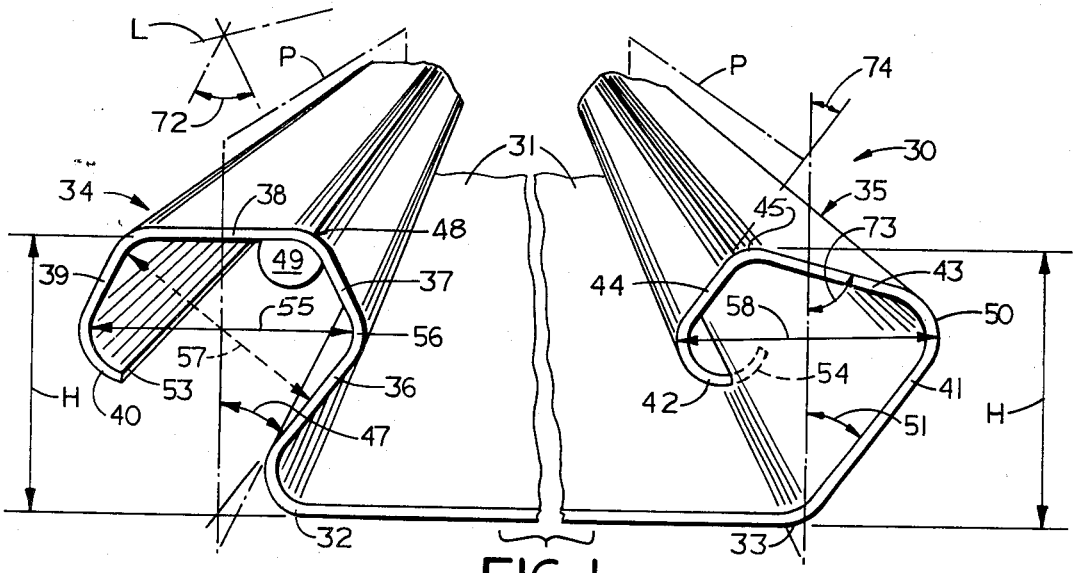
FIG. 1 is a broken isometric view illustrating the polysurfaced male and female lips which constitute the joint of this invention.

FIG. 1 illustrates a fragment of a sheet metal panel 30 comprising a central web 31 presenting opposite first and second web edges 32, 33; and upstanding polysurfaced female and male lips 34, 35 adjoined, respectively, to the first and second web edges 32, 33. The panel 30 may be produced by roll forming operations from material having a thickness of from 18 to 26 gage, that is, 0.0478 to 0.0179 inch (1.21 to 0.45 millimeters) depending on the intended use of the panel 30. For example, for single skin wall or roof applications, the panel 30 may be formed from materials having a thickness of from 18 to 22 gage, i.e., 0.0478 to 0.0299 inch (1.21 to 0.759 millimeter). Where the panel 30 comprises the outer skin of a composite panel, such as a double-skin foam core panel, the panel 30 may be formed from materials having a thickness of from 24 to 26 gage, i.e., 0.0239 to 0.0179 inch (0.607 to 0.455 millimeter). Suitable materials for use in either of the above-identified applications include sheet metal provided with a tough weather-resistant coating on one or both surfaces, stainless steel, aluminum, copper, terne, and reinforced plastics.

In general, the polysurfaced female lip 34 comprises, in sequence and relative to the first web edge 32: an upwardly and inwardly extending first element 36, an upwardly and outwardly extending second element 37, an outwardly extending third element 38, an outwardly and downwardly extending fourth element 39, and a re-entrant arcuate terminal element 40. A bead 49 of sealant material is applied to an interior surface of the female lip 34. As will hereinafter be explained, the bead 49 may be applied along any line in a region of the female lip 34 which includes the contiguous interior surfaces of the first through third elements 36, 37, 38; and preferably a region which includes the contiguous interior surfaces of the first and second elements 36, 37. The bead 49 may, as illustrated in FIG. 1, be applied at the juncture 48 of the second and third elements 37, 38.

In general, the polysurfaced male lip 35 comprises relative to the second web edge 33: an upwardly and outwardly extending first leg 41, and laterally spaced therefrom a re-entrant arcuate terminal leg 42. The terminal leg 42 is disposed over and spaced from the central web 31. The first leg 41 and the terminal leg 42 are joined by at least two distinct legs, that is a second leg 43 and a third leg 44, and intermediate thereof at least one arcuate bend 45 which resides at a level above the terminal leg 42. As will hereinafter be explained, the lips 34, 35 are configured for snap-fit engagement with complementary lips of adjacent ones of the panel 30 to secure the central webs thereof in fixed angularly spaced-apart relation relative to each other.

The upper portion of the female lip 34 which is constituted by the second, third and fourth elements 37, 38, 39 is symmetrical about a vertical plane P extending normal to the third element 38 and longitudinally through the center of the female lip 34. Also, the second and fourth elements 37, 39 converge toward a line L which is spaced above the third element 38 and which resides in the plane P. The symmetry of the upper portion provides a visual resemblance to stiffening ribs 46 (FIGS. 18, 19) formed in the central web 31 of a roof panel 68.

In the preferred arrangement, the upper portion of the male lip 35 constituted by the second and third legs 43, 44 and the arcuate bend 45, is unsymmetrical about the plane P. That is, the arcuate bend 45 is laterally offset from the plane P and is remote from the juncture 50 of the first and second legs 41, 43. As a result, the second leg 43 will cooperate with the second and third elements 37, 38 of the female lip 34 to provide a pocket 67 (FIG. 7) for the bead 49 of sealant material.

The sheet metal panel 30 is roll formed from material having a selected girth. The edge of the material corresponding to the re-entrant tip 53 of the terminal element 40 is the control edge. Should the material exceed the selected girth, the excess material appears in the male lip 35 as a run-out flange shown in dotted lines at 54. The run-out flange 54 will not interfere with the interconnection of the female and male lips 34, 35.

It will be observed in FIG. 1 that the first element 36 and the first leg 41 are inclined in the same direction and at angles 47 and 51, respectively, relative to the plane P. The angle 51 of the first leg 41 may be equal to but preferably is less than the angle 47 of the first element 36 so as to provide for roll forming tolerances. The first element 36 and the first leg 41 constitute—in the joint 61 (FIG. 7)—overlapping members which coact with the other elements and legs of the lips 34, 35 to resist vertical disengagement of either of the lips 34, 35 relative to the other lip 35, 34 when the adjacent panels 30A, 30B are subjected to non-uniform loading. That is, upward movement of the panel 30B is resisted, in part, by the overlapping first leg 41, whereas downward movement of the panel 30A is resisted, in part, by the underlapped first element 36.

In accordance with this invention, the male lip 35 of one panel is configured to provide a snap-fit engagement with the female lip 34 of an adjacent panel. To fully understand the mechanics of the snap-fit engagement, the spatial relationship of certain of the elements and certain interior and exterior dimensions of the lips 34, 35 will be explained with reference to FIG. 1.

In the male lip 35, it is essential that the uppermost surface of the arcuate bend 45 be at a level above the juncture 50 and the re-entrant arcuate terminal leg 42. Thus positioned, the arcuate bend 45 acts as a cam element which forces the terminal leg 42 to slide relative to the fourth leg 39 as will hereinafter be described.

The female lip 34 has an interior width indicated at 55, that is the distance between the interior surface of the terminal element 40 and the interior surface of the juncture 56 of the first and second elements 36, 37. The normal distance from the interior surface of the fourth element 39 to the interior surface of the first element 36 is represented by the dashed dimension line 57. The male lip 35 has a maximum width indicated at 58, that is the distance between the exterior surfaces of the terminal leg 42 and the juncture 50. In accordance with the present invention, the maximum width 58 of the male lip 35 is equal to or less than the maximum interior width 55 of the female lip 34. In order to achieve the desired snap-fit relation between the male and female lips 35, 34, the normal distance 57 of the female lip 34 is less than the maximum width 58 of the male lip 35.

In a commercial embodiment of the sheet metal panel 30, the female lip 34 has a height of 1.5 inches (38.1 millimeters), an interior width 55 of 1.45 inches (36.8 millimeters), and a normal distance 57 of 1.30 inches (33.0 millimeters). The second and fourth elements 37, 39 have an angle of convergance 72 of about 53.1 angular degrees. The male lip 35 has an overall height H of 1.5 inches (38.1 millimeters) and a maximum width 58 of 1.42 inches (36.1 millimeters). The first distinct leg 43 has an angle of inclination 73 of about 75.1 angular degrees relative to the plane P, and the second distinct leg 44 has an angle of inclination 74 of 37.1 angular degrees relative to the plane P.

The sequence of forming the present joint 61 (FIG. 7) between two of the building panels 30A, 30B is illustrated in FIGS. 2 through 7. A first panel 30A (FIG. 2) is secured to support members 59 (only one visible). A second panel 30B is installed by hooking the female lip 34 thereof over the male lip 35 (FIG. 2); and then moving the second panel 30B laterally (FIG. 3) until the re-entrant terminal leg 42 engages the interior surfaces of the third and fourth elements 38, 39. It will be observed in FIGS. 2 and 3 that the juncture 60 between the first element 36 and the central web 31B may engage and slide over the first distinct leg 43 during lateral movement of the second panel 30B.

The second panel 30B (FIG. 3) is rotated in a clockwise direction about the male lip 35 until the arcuate bend 45 (FIG. 4) engages the interior surface of the third element 38. As the panel 30B is rotated from the position of FIG. 3 to that of FIG. 4, the first and third elements 36, 38 are spread apart by the juncture 50 and the terminal leg 42 of the male lip 35. The normal distance 57 is increased, that is approaches the maximum width 58 of the male lip 35. Once the arcuate bend 45 engages the third element 38 and the panel 30B is rotated further in a clockwise direction, the first, third and fourth elements 36, 38 and 39 are spread apart by the cooperative action of the junction 50, the arcuate bend 45 and the terminal leg 42. The resulting three lines of contact (represented by the triangles) preclude binding of the male lip 35 within the female lip 34.

Figure 4:
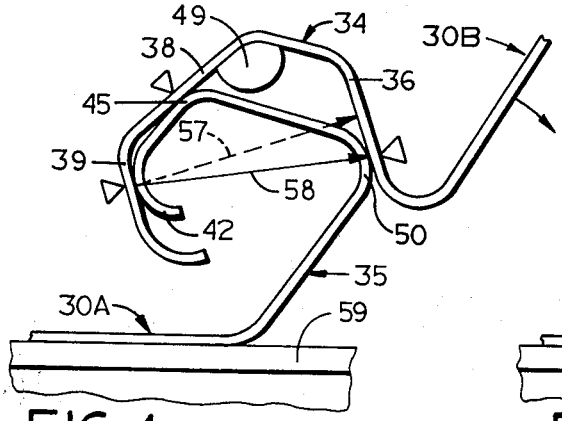
Figure 5:
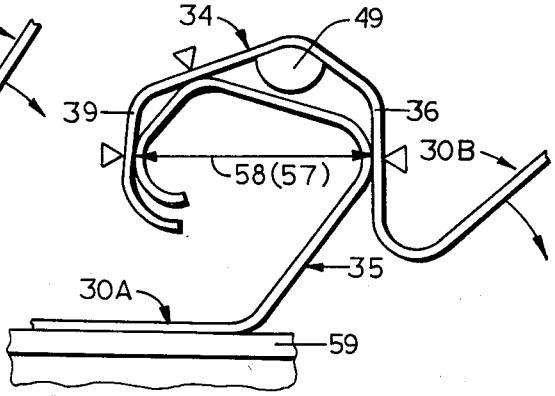

As the panel 30B is rotated from the position of FIG. 4 to that of FIG. 5, the first and third elements 36, 39 are spread apart such that the normal distance 57 equals that of the maximum width 58.

Figure 6:
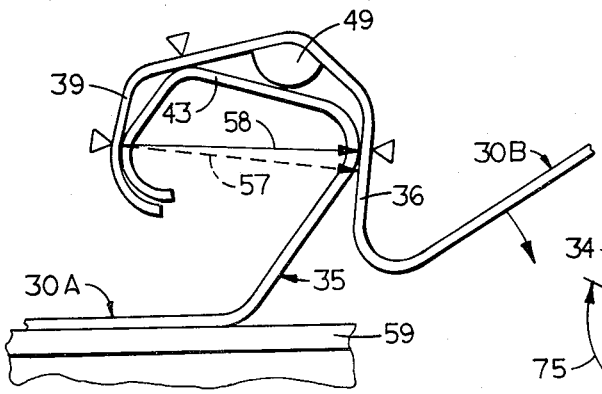
Figure 7:
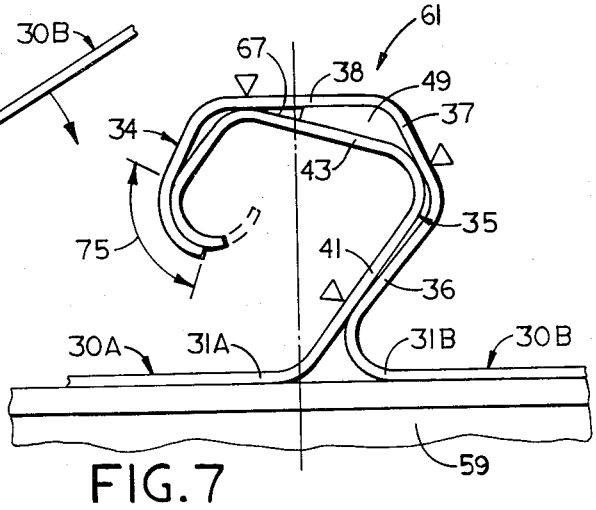

As the panel 30B is rotated from the position of FIG. 5 to that of FIG. 6, the first and fourth elements 36, 39 move toward each other and the normal distance 57 decreases. Thereafter, the second panel 30B is rotated to the final installed position (FIG. 7). It will be observed in FIG. 7 that the male lip 35 is interlocked with the female lip 34 to provide a joint 61 which secures the adjacent central webs 31A, 31B in fixed angular relation to each other.

It will also be observed in FIGS. 2 through 6 that the bead 49 of sealant material remains out of contact with the male lip. After the panel 30B is rotated beyond the position illustrated in FIG. 6, the bead 49 engages the exterior surface of the first distinct leg 43. In the joint 61 (FIG. 7) the bead 49 of sealant material is compressed between the interior surface of at least the second element 37 and the exterior surface of the first distinct leg 43.

Figure 3:
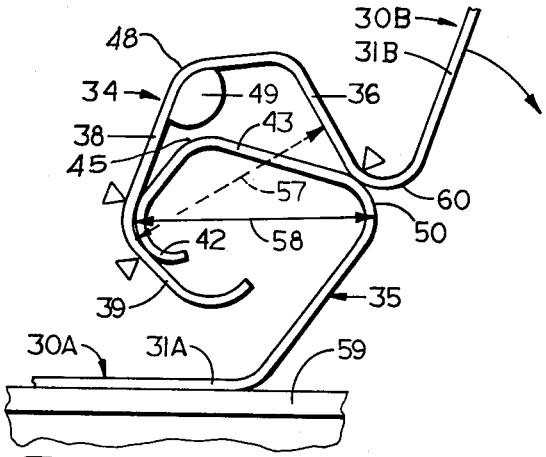

It will further be observed that as the panel 30B rotates from the position of FIG. 3 to the final position of FIG. 7, the female lip 34 and the male lip 35 are in line contact along three angularly spaced-apart lines indicated by the triangles; and are in surface contact between the terminal element 40 and the terminal leg 42 along the arcuate region 75. The three line contacts and the surface contact are maintained throughout the length of the joint 61. The arrangement is such that the male and female lips 34, 35 are self-aligning and self-seating.

Figure 11:
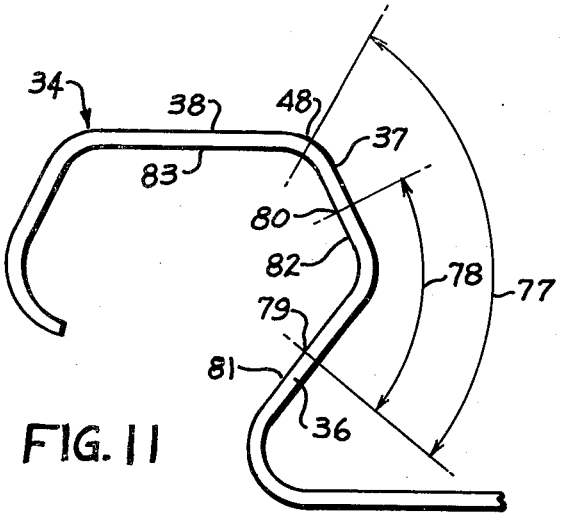
FIG. 11 is a fragmentary end view of the female lip illustrating ranges within which the bead of sealant material may be applied.

The bead 49 of sealant material must be so located within the female lip 34 that a weather-tight seal is assured. In accordance with this invention the bead 49 may be applied, as illustrated in FIG. 11, along any line residing substantially within a region 77 which includes the contiguous interior surfaces 81, 82 and 83 of the first through third elements 36–38. Specifically the region 77 extends approximately from the mid-line 79 of the first element 36 to the juncture 48 of the second element 37 with third element 38. In the preferred arrangement, the bead 49 may be applied along any line residing substantially within a preferred region 78 which includes the contiguous interior surfaces 81 and 82. Specifically, the preferred region 78 extends approximately from the mid-line 79 of the first element 36 to the mid-line 80 of the second element 37.

Figure 12:
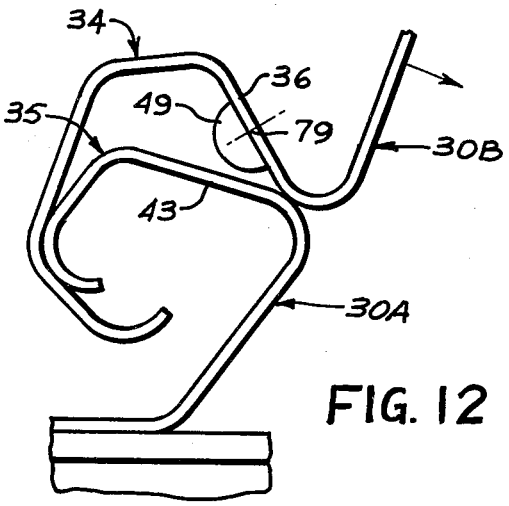
FIGS. 12 and 13 are end views of adjacent panels positioned as in FIGS. 3 and 4, illustrating sealant material applied to the first element and wiping thereof by the male lip.
Figure 13:
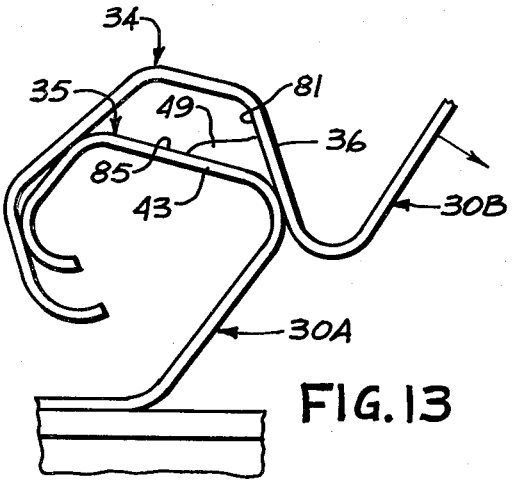
Figure 14:
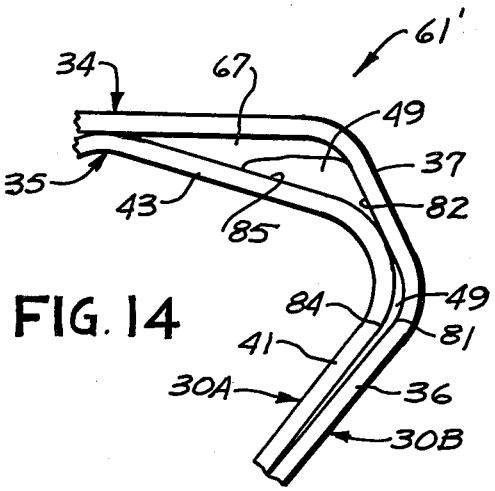
FIG. 14 is a fragmentary end view of the joint formed by the panels of FIGS. 12, 13.

The bead 49 of sealant material may be applied along the mid-line 79 of the first element 36 (FIG. 12). As the panel 30B is rotated clockwise, the bead 49 engages the exterior surface 85 of the first distinct leg 43 (FIG. 13) and is spread thereby along the interior surface 81 of the first element 36. It will be observed in the resulting joint 61' (FIG. 14) that the sealant material 49 has been spread and is compressed between (a) the contiguous interior surfaces 81, 82 of the female lip elements 36, 37 and (b) the contiguous exterior surfaces 84, 85 of the male lip legs 41, 43.

Figure 15:
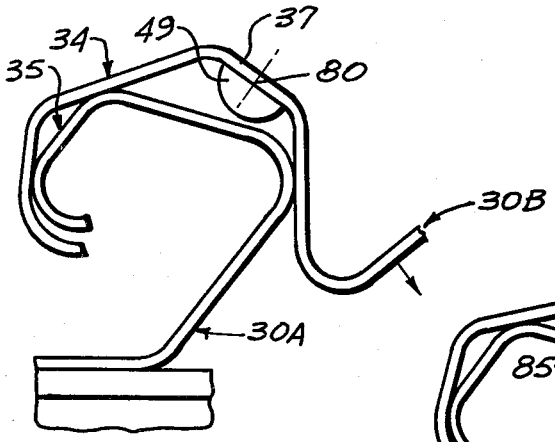
FIGS. 15 and 16 are end views of adjacent panels positioned as in FIGS. 5 and 6, illustrating sealant material applied to the second element and wiping thereof by the male lip.
Figure 16:
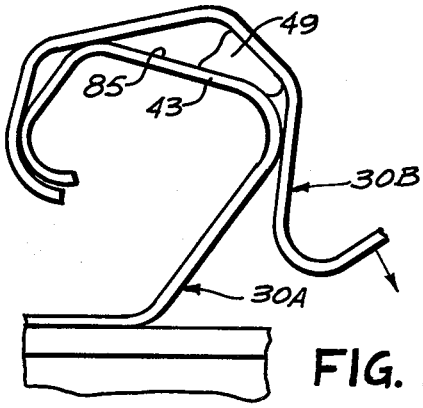
Figure 17:
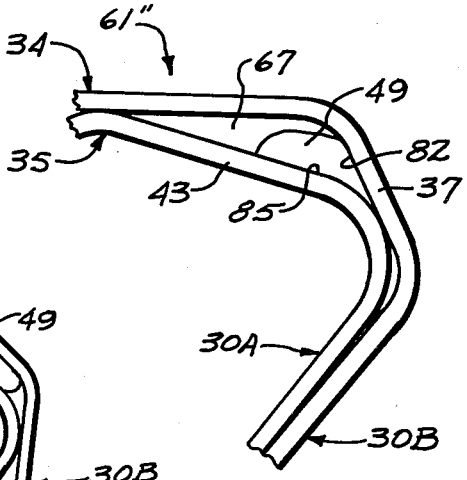
FIG. 17 is a fragmentary end view of the joint formed by the panels of FIGS. 15, 16.

The bead 49 of sealant material may also be applied along the mid-line 80 of the second element 37 (FIG. 15). As the panel 30B is rotated clockwise, the bead 49 engages the exterior surface 85 of the first distinct leg 43 and is displaced thereby. It will be observed in the resulting joint 61'' (FIG. 17) that the sealant material is compressed between the interior surface 82 of the female lip element 37 and the exterior surface 85 of the male lip leg 43.

Where the bead 49 is provided along the juncture 48 (FIGS. 2–7), a weather-tight seal can be formed provided the bead 49 does not contact the arcuate bend 45 of the male lip 35. Such contact would cause a portion of the bead 49 to be displaced away from the cavity 67 (FIG. 7); and the amount of sealant remaining would be insufficient to form an adequate weather-tight seal. Undesirable contact with the arcuate bend 45 can be prevented if the female lip 34 is engaged with and rotated about the male lip 35 in the manner illustrated in FIGS. 2 to 7.

Because of the possible occurrence of the above-described premature "contact", the bead 49 preferably is provided along any line residing substantially within the preferred region 78 (FIG. 11). It will be observed in FIGS. 12, 13 and 15, 16 that displacement of the bead 49 by the first distinct leg 43 is always toward the subsequently formed cavity 67 (FIGS. 14, 17) and not away from the cavity 67.

Figure 9:
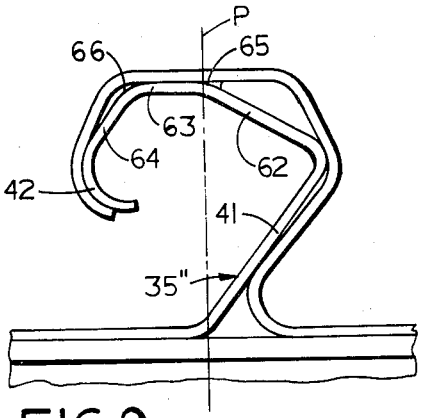
FIGS. 8 and 9 are views similar to FIG. 7, illustrating alternative male lip configurations.
Figure 8:
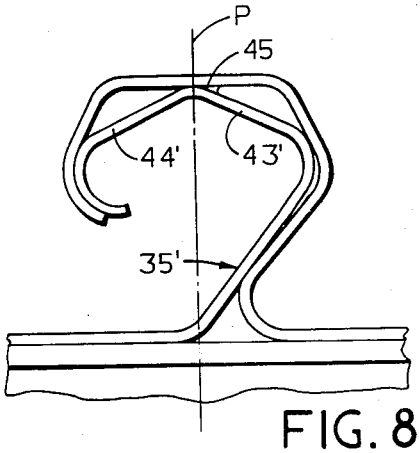
Figure 10:
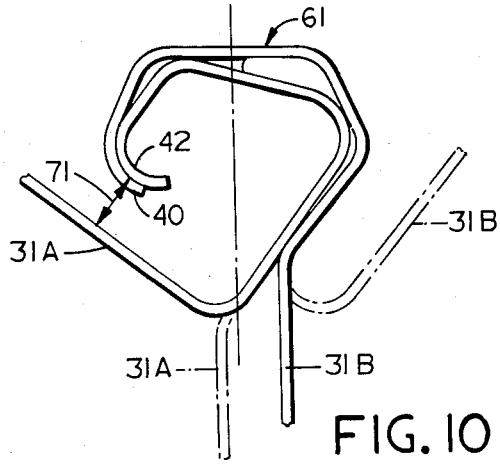
FIG. 10 is a view similar to FIG. 7, illustrating alternative angular relationships between the adjacent webs.

Alternative arrangements of the present joint are illustrated in FIGS. 8 through 10. Corresponding numerals will be employed to identify corresponding parts heretofore described.

FIG. 8 illustrates an arrangement wherein the first and second distinct legs 43', 44' of the male lip 35 are of substantially identical width and the arcuate bend 45 is centered on the plane P.

FIG. 9 illustrates an arrangement wherein the first leg 41 and the terminal leg 42 of the male lip 35'' are joined by three distinct legs 62, 63 and 64 and intermediate thereof two arcuate bends 65 and 66.

The first leg 41 and terminal leg 42 may be connected by a plurality of distinct legs and arcuate bends. However, to minimize the amount of girth required to form the lips, it is preferred that the first and terminal legs 41, 42 be connected by the two distinct legs 43, 44 and the single arcuate bend 45. It is also preferred that the arcuate bend 45 be offset from the plane P as illustrated in FIG. 1 so as (a) to maximize the size of the sealant pocket 67 (FIG. 7); (b) to preclude undesirable contact of the arcuate bend 45 with the bead 49 of sealant material during interengagement of the lips 34, 35; and (c) to facilitate the above-described cam function of the arcuate bend 45.

Figure 2:
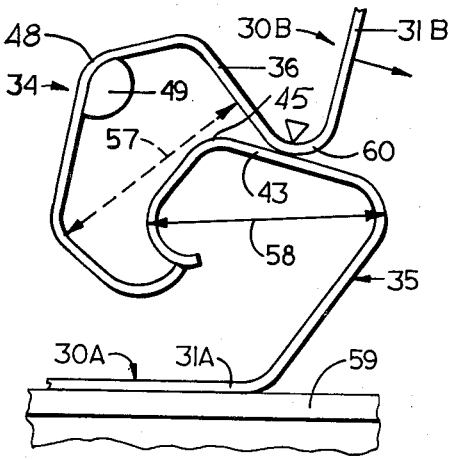
FIGS. 2 through 7 are fragmentary end views illustrating the sequence of forming the joint of this invention.

In FIG. 7, the joint 61 secures the adjacent central webs 31A, 31B in coplanar relation. It should be evident that the angular relation of the central webs 31A, 31B may, as illustrated in FIG. 10, be altered as required. The only requirement is that the normal distance 71 between the terminal leg 42 and the web 31A be sufficiently large to permit passage of the terminal element 40 during interengagement of the lips 34, 35 as illustrated in FIGS. 2 and 3.

Figure 18:
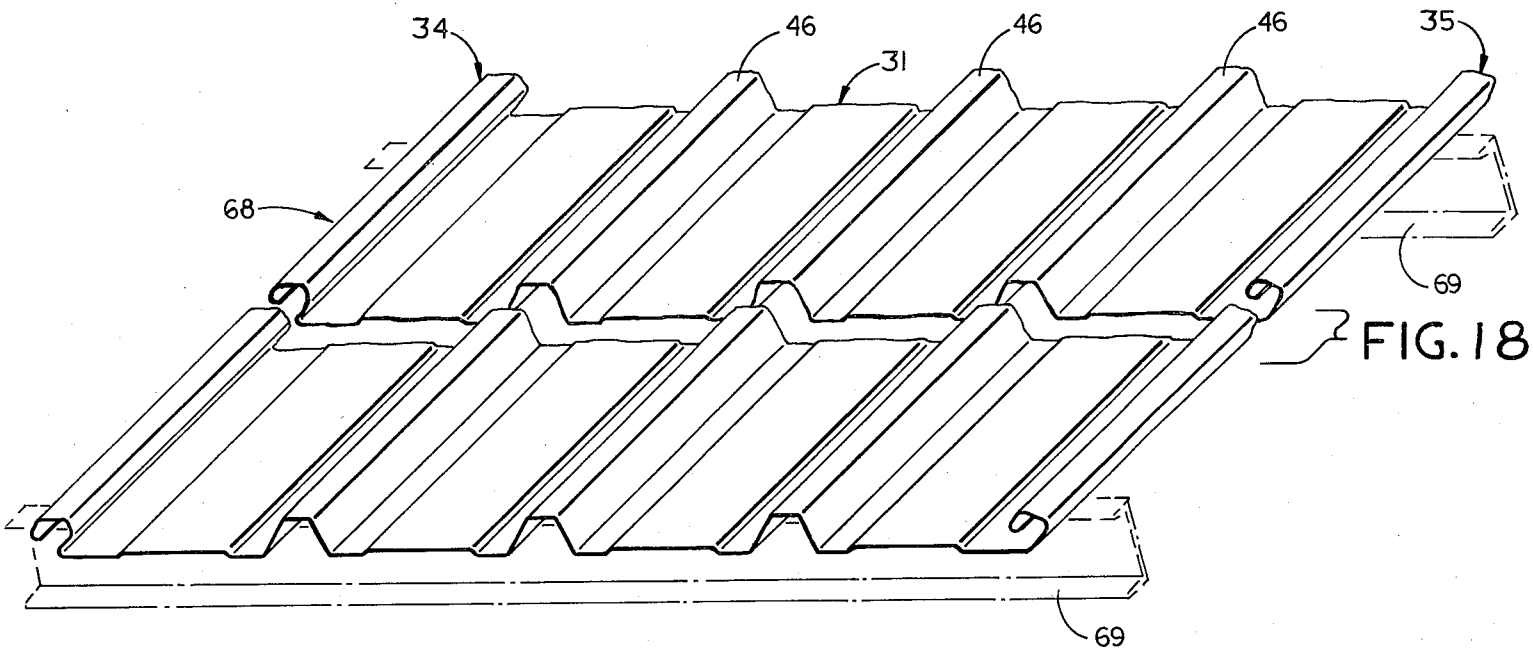
FIG. 18 is a broken isometric view illustrating a roofing panel incorporating the male and female lips of this invention.
Figure 19:
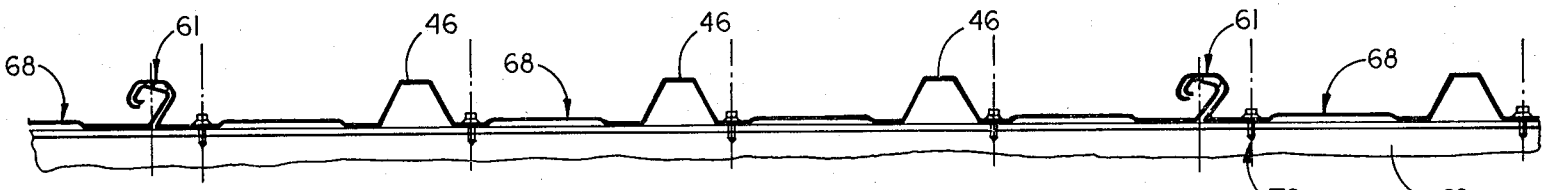
FIG. 19 is an end view of a roof structure assembled from a plurality of the roofing panels of FIG. 18.

FIG. 18 illustrates a roof panel 68 presenting the upstanding polysurfaced female and male lips 34, 35 along the opposite edges of the central web 31. The central web 31 may be provided with any suitable profile which enhances the structural and aesthetic characteristics of the roof panel 68. In FIG. 18, the central web 31 is provided with spaced-apart ribs 46—the upper portion of the female lip 34 having a visual resemblance to the upper portion of the ribs 46. The roof panel 68 is adapted to span across plural support members, such as the purlins 69. A plurality of the roof panels 68 may be assembled, as shown in FIG. 19, in side-by-side relation wherein the joints 61 of this invention connect adjacent roof panels. Each of the roofing panels 68 is secured to the purlins 69 by plural fasteners 70.

I claim:

1. A joint comprising:

adjacent central webs presenting confronting first and second web edges, a polysurfaced female lip adjoined to the first web edge and comprising, in sequence, relative to the first central web edge:

an upwardly and inwardly extending first element, an upwardly and outwardly extending second element, an outwardly extending third element, an outwardly and downwardly extending fourth element, and a re-entrant terminal element;

a polysurfaced male lip adjoined to the second web edge and comprising:

an upwardly and outwardly extending first leg overlapping said first element, a re-entrant arcuate terminal leg engaged with said re-entrant terminal element, and said first leg and said terminal leg being joined by at least two distinct legs and intermediate thereof at least one arcuate bend, said arcuate bend being in engagement with an interior surface of said female lip;

said male lip being interlocked with said female lip thereby to provide said joint which secures the adjacent central webs in fixed angular relation to each other.

2. The joint of claim 1 wherein the normal distance between the interior surfaces of said fourth element and of said first element is at least less than the maximum distance between the exterior surfaces of said re-entrant arcuate terminal leg and the juncture of said first leg and the adjoining one of said two distinct legs.

3. The joint of claim 1 including sealant material compressed between the interior surface of at least said second element, and the exterior surface of a confronting leg of said two distinct legs.

4. The joint of claim 1 wherein said arcuate bend engages said outwardly extending third element.

5. The joint of claim 1 wherein said arcuate bend is laterally offset from a plane extending normal to said third element and longitudinally through the center of said joint.

6. The joint of claim 5 wherein said arcuate bend is remote from said second element.

7. The joint of claim 5 wherein said two distinct legs are of different widths.

8. The joint of claim 5 wherein said two distinct legs have substantially equal widths.

9. The joint of claim 1 wherein the second and fourth elements converge toward a line spaced above and generally parallel with said third element.

10. The joint of claim 9 wherein said line resides in a plane extending normal to said third element and longitudinally through the center of said joint.

11. The joint of claim 1 wherein said arcuate bend, the juncture between said first leg and one of said two distinct legs, and said first leg of said male lip engage interior surfaces of said female lip along three distinct lines of contact which extend substantially the entire length of said joint.

12. The panel of claim 1 including a bead of sealant material applied along any line in a region of said female lip which includes the contiguous interior surfaces of said first element, said second element and said third element.

13. The panel of claim 12 wherein said region extends approximately from the mid-line of said first element to the juncture of said second element with said third element.

14. The panel of claim 1 including a bead of sealant material applied along any line in a region of said female lip which includes the contiguous interior surfaces of said first element and said second element.

15. The panel of claim 14 wherein said region extends approximately from the mid-line of said first element to the mid-line of said second element.

16. A roof structure comprising plural roofing panels assembled in side-by-side relation, supported on and secured to spaced-apart purlins, and connected in interlocked relation by plural upstanding joints, each of said joints comprising:

adjacent ones of said roofing panels having central webs presenting confronting first and second web edges, an upstanding polysurfaced female lip adjoined to the first web edge and comprising:

a first element extending upwardly from and inwardly over the first web edge, a second element extending upwardly from and outwardly of said first element, a third element extending laterally outwardly from said second element and beyond said first and second web edges, a fourth element extending outwardly of and downwardly from said third element, and a re-entrant terminal element adjoined to said fourth element and spaced above the central web of said first roofing panel; and an upstanding polysurfaced male lip adjoined to the second web edge and comprising:

a first leg extending upwardly from and outwardly of the second web edge and overlapping said first element, a re-entrant arcuate terminal leg engaged with said re-entrant terminal element, said first leg and said re-entrant arcuate terminal leg being joined by at least two distinct legs and intermediate thereof at least one arcuate bend, said arcuate bend being in engagement with an interior surface of said female lip;

said male lip being interlocked with said female lip thereby to secure adjacent roofing panels in fixed relation to each other.

17. The roof structure of claim 16 wherein each of said joints includes sealant material compressed between the interior surface of at least said second element, and the exterior surface of a confronting one of said two distinct legs.

18. An interlocking panel having a central web presenting a first web edge and opposite thereto a second web edge, and complementary lips, one adjoined to and extending along each said web edge, said complementary lips comprising:

a polysurfaced female lip including, in sequence, relative to said first web edge:

an upwardly and inwardly extending first element, an upwardly and outwardly extending second element, an outwardly extending third element, an outwardly and downwardly extending fourth element, and a re-entrant terminal element; and a polysurfaced male lip including, in sequence, relative to said second web edge:

an upwardly and outwardly extending first leg, a re-entrant arcuate terminal leg disposed over and spaced from said central web, said first leg and said terminal leg being joined by at least two distinct legs and intermediate thereof at least one arcuate bend, said arcuate bend residing at a level above said terminal leg;

said lips being configured for snap-fit engagement with complementary lips of adjacent ones of said panel thereby to secure the central webs thereof in fixed angularly spaced-apart relation relative to each other.

19. The panel of claim 18 wherein the normal distance between the interior surfaces of said fourth element and of said first element is at least less than the maximum distance between the exterior surfaces of said re-entrant arcuate terminal leg and of the juncture of said first leg and the adjoining one of said two distinct legs.

20. The panel of claim 18 wherein said arcuate bend is laterally offset from a plane extending normal to said central web and longitudinally through the center of said male lip.

21. The panel of claim 20 wherein said arcuate bend is remote from said first leg.

22. The panel of claim 20 wherein said two distinct legs are of different widths.

23. The panel of claim 20 wherein said two distinct legs have substantially equal widths.

24. The panel of claim 18 wherein the second and fourth elements converge toward a line spaced above and generally parallel with said third element.

25. The panel of claim 24 wherein said line resides in a plane extending normal to said third element and longitudinally through the center of said female lip.

* * * * *